US007540654B2

(12) United States Patent
Cabezas Jurin et al.

(10) Patent No.: US 7,540,654 B2
(45) Date of Patent: Jun. 2, 2009

(54) TANGENTIAL IMPULSE ESCAPEMENT

(75) Inventors: Andrés Cabezas Jurin, Yverdon-les-Bains (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/043,251

(22) Filed: Mar. 6, 2008

(65) Prior Publication Data

US 2008/0219104 A1 Sep. 11, 2008

(30) Foreign Application Priority Data

Mar. 9, 2007 (EP) ..... 07103860

(51) Int. Cl.
*G04B 15/00* (2006.01)

(52) U.S. Cl. ..... 368/127; 368/131

(58) Field of Classification Search ..... 368/124–133, 368/168, 169

See application file for complete search history.

(56) References Cited

U.S. PATENT DOCUMENTS

| | | | | |
|---|---|---|---|---|
| 22,791 A | | 2/1859 | Fasoldt | |
| 3,628,327 A | * | 12/1971 | Abe | 368/124 |
| 3,803,830 A | * | 4/1974 | Lawson | 368/129 |
| 4,041,693 A | * | 8/1977 | Bonsack | 368/124 |
| 6,301,981 B1 | * | 10/2001 | Oechslin | 74/1.5 |
| 6,846,104 B2 | * | 1/2005 | Geyer | 368/127 |
| 6,863,434 B2 | * | 3/2005 | Mojon | 368/127 |
| 6,942,378 B2 | * | 9/2005 | Hayek et al. | 368/127 |
| 7,097,350 B1 | * | 8/2006 | Conus et al. | 368/127 |

FOREIGN PATENT DOCUMENTS

EP 0 018 796 11/1980

OTHER PUBLICATIONS

European Search Report issued in corresponding application No. EP 07 10 3860, completed Jan. 15, 2008.

Chamberlain, Paul M., "It's About Time," The Holland Press Ltd, London, 1964, p. 79.

Daniels, George, "La Montre: Principles et Methodes de Fabrication," Scriptar Editiions S.A., La Conversion/Lausanne, 1993, pp. 249-252.

* cited by examiner

*Primary Examiner*—Vit W Miska
(74) *Attorney, Agent, or Firm*—Griffin & Szipl, P.C.

(57) ABSTRACT

The tangential impulse escapement includes a lever device (1) including a lever (3) driving a roller (65) and a ring (7) surrounding an escapement wheel set (8), said ring being fitted with pallet-stones (9, 10, 11, 12) for cooperating with the teeth (13, 14, 15, 16) of said wheel set, in order, alternately, to lock the latter then import an impulse to said roller. The escapement wheel set includes at least first (17) and second (18) coaxial secured wheels. The pallet pallet-stones (9, 11, 12) of the ring cooperate with the teeth (13, 15, 16) of the first wheel (17) with the exception of one (10), which is arranged for cooperating with the teeth of the second wheel (18).

5 Claims, 4 Drawing Sheets

TANGENTIAL IMPULSE ESCAPEMENT

This application claims priority from European Patent Application No. 07103860.8, filed Mar. 9, 2007, the entire disclosure of which is incorporated herein by reference.

FIELD OF THE INVENTION

The present invention relates to an tangential impulse escapement including a lever device hinged on a pivot, the lever device including, as a first arm, a lever ending in a fork for cooperating with an impulse pin of a roller and, as a second arm, opposite to the first, a ring substantially surrounding an escapement wheel set, this ring being fitted with locking pallet-stones and impulse pallet-stones for cooperating with the teeth of said wheel set in order, alternately, to block and release said roller.

BACKGROUND OF THE INVENTION

This type of escapement is known and described in the work by Paul M. Chamberlain entitled "It's About Time", published in London in 1978 by The Holland Press. The author describes a tangential impulse escapement by the Brothers Melly at page 79. FIG. 1 of this description shows a drawing of this prior art.

The escapement in question includes a lever device B hinged on a pivot. The top arm of this lever device is formed by a lever ending in a fork for cooperating with an impulse pin L of a roller A. The bottom arm includes a ring surrounding an escape wheel. The ring carries four pallet-stones, namely two impulse pallet-stones R and R' for imparting an impulse to roller A and two locking pallet-stones D and D' for locking the escape wheel, the latter including teeth E, F, G, H cooperating with the pallet-stones of the ring.

FIG. 1 shows an operating phase of the escapement of the prior art. Preceding this phase, tooth F of the wheel was locking against locking pallet-stone D. Roller A, rotating in the direction of arrow C has released the escape wheel, which then rotates in the direction of arrow P. Tooth E of the wheel enters into contact with pallet-stone R of the ring, which causes lever device B to rotate in the direction of arrow Q and imparts an impulse to the roller by impulse pin L in the direction of arrow C. Once this impulse has ended, the wheel and more specifically the tooth H thereof is locked by face D'. From this moment, the roller travels through its additional arc and reverses its direction. Impulse pin L then drives the fork in the opposite direction and the lever device rotates in the opposite direction to that shown by arrow Q. The locking of tooth H on impulse pallet-stone D' is interrupted, which enables tooth G of the wheel to impart another impulse to the ring via the impulse pallet-stone R' thereof and to send roller A back again.

The explanations given above show that this is a tangential impulse escapement. Indeed, the impulse is imparted by the top of the tooth of the escape wheel onto a point of the pallet-stone that remains the same during the entire duration of the impulse, like the teeth of a gear. There is thus no or very little sliding of the tooth on the pallet-stone, which is not the case of a lever escapement, for example. The tangential impulse escapement thus does not involve any lubrication system, which is very fragile, prone to aging and currently used in lever escapements. It will be noted however that a single lubrication is carried out in order to prevent any wear phenomenon of the members in contact with each other.

It will also be indicated that a tangential impulse escapement was described in the work of G. Daniels entitled: "La montre: Principles et Méthodes de Fabrication" at pages 249 to 252, Scriptar Editions S. A., La Conversion/Lausanne, 1993. This escapement, called a coaxial escapement, includes two impulse-receiving pallet-stones, one located on the lever, the other directly associated with the roller. It may be considered that the present invention simplifies matters by associating the two impulse pallet-stones with a single lever.

Returning now to the Brothers Melly escapement shown in FIG. 1, it will be seen that it is affected by at least two drawbacks: its space requirement and operating reliability, which does not seem sure.

FIG. 1 shows that the space requirement of the Brothers Melly system is difficult to reconcile with use in a watch of normal size. The length of the system would be difficult to incorporate in a timepiece worn on the wrist.

In the same Figure, two angles are drawn: a first angle $\alpha$ showing the angle of displacement of impulse pallet-stone R for the duration of the impulse and a second angle $\beta$ showing the angle of displacement of the tip of tooth E for the same impulse duration. We have: $\alpha=2°$ and $\beta=8°$. In other words, the impulse that the impulse pallet-stone receives from the tooth by is only effective over an excursion of 2 degrees of the lever and one might wonder whether such a short angle can transmit all of the energy deployed by the escape wheel to the roller. Moreover, this very small angle leaves no security margin, given the inherent manufacturing tolerances of the mechanical parts involved here. The situation is however slightly better as regards impulse pallet-stone R' and tooth G where measurements of $\alpha=3.5°$ and $\beta=14°$ have been taken (this situation is not shown in the drawings).

SUMMARY OF THE INVENTION

In order to avoid the drawbacks described above, in addition to answering the description given in the first paragraph of this description, the present invention is characterized in that the escape wheel set includes a plurality of secured and coaxial wheels, including at least first and second wheels, the first wheel having a larger diameter than the second, said first and second wheels each cooperating with an impulse pallet-stone fitted to the ring, the locking pallet-stones being arranged for cooperating with any of the wheels of the escape wheel set.

BRIEF DESCRIPTION OF THE DRAWINGS

The invention will now be explained in detail below by one embodiment, given by way of non-limiting example, this embodiment being illustrated by the annexed drawings, in which.

DETAILED DESCRIPTION OF THE ILLUSTRATIVE EMBODIMENTS

Figure 1:
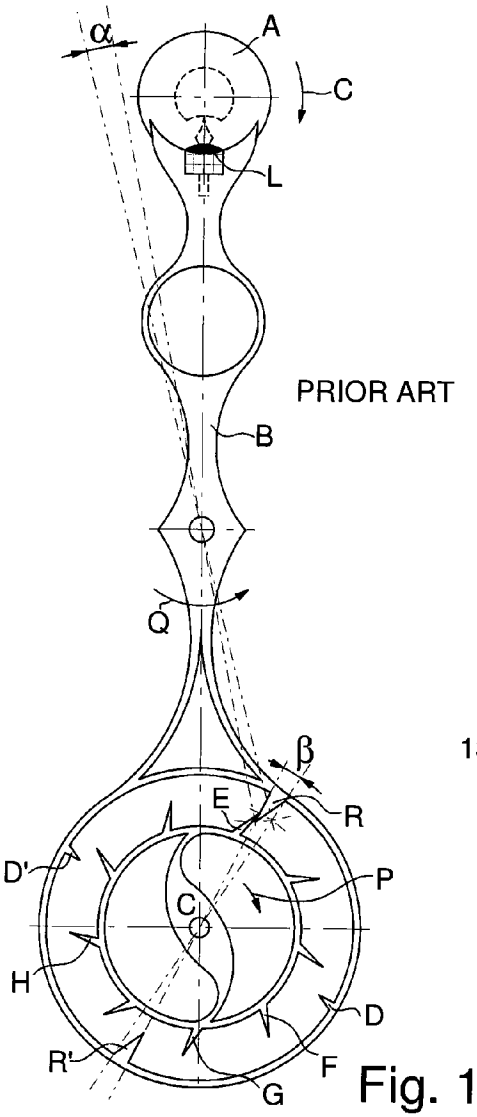
FIG. 1 is a plan view of a tangential impulse escapement according to the prior art.

FIGS. 2 to 15 show plan views of the tangential impulse escapement. This escapement includes a lever device 1 hinged on a pivot 2. Lever device 1 includes as a first arm a lever 3 ending in a fork 4. Fork 4 cooperates with an impulse pin 5 secured to a roller 6. In a known manner, the roller is attached to a sprung balance, which is not shown in the drawings. The second arm of lever device 1, opposite to the first arm, includes a ring 7, which substantially surrounds an escape wheel set 8. Also in a known manner, the escape wheel set is driven by the gear train of a timepiece, which draws its energy from a barrel spring, for example. When the escape wheel set is not locked, it rotates in the direction of arrow 20. Ring 7 is fitted with locking and impulse pallet-stones secured to the inner belt thereof. The pallet-stones are for cooperating with teeth of the escape wheel set 8 in order, alternately, to lock said wheel set 8 and then sending roller 6 back again.

The escapement of the invention is original in that escape wheel set 8 includes a plurality of secured and coaxial wheels including at least first and second wheels 17 and 18, the first wheel having a larger diameter than the second wheel 18. These first and second wheels cooperate with an impulse pallet-stone 10 and 12 fitted to ring 7. The pallet-stone faces 9 and 11 are arranged for cooperating with any of the wheels of escape wheel set 8.

Thus, in its most general sense, the invention proposes an escape wheel set able to include more than two wheels secured and mounted coaxially to each other, the essential point consisting in having at least two wheels of different diameter, each of the latter activating its own impulse pallet-stone. It is the implementation of these two wheels of different diameter that improves the Brothers Melly escapement both as regards space requirement and as regards security as will be seen below. In this new system, the locking pallet-stones can cooperate equally well with the large or small wheel or both at the same time or even with a third wheel which is entirely allotted thereto.

More specifically, in the embodiment taken by way of non-limiting example here, ring 7 includes first and second impulse pallet-stones 12 and 10 respectively cooperating with the teeth of the first and second escape wheels 17 and 18. In this same embodiment, first and second locking pallet-stones 11 and 9 cooperate with the teeth of the first escape wheel 17.

In this example and as the Figures show well, the pallet-stones are arranged alternately inside ring 7. Turning in an anticlockwise direction, the first impulse pallet-stone 12 is followed by the first locking pallet-stone 11. The latter is followed in turn by the second impulse pallet-stone 10, this latter being followed finally by the second locking pallet-stone 9.

The second impulse pallet-stone 10 is secured to the end of a leg 19, this leg being secured to ring 7 via its other end. Finally, it will be noted that leg 19 is substantially orientated in the extension of lever 3, forming part of the first arm of lever device 1.

It was stated in the preamble of this description that the escapement proposed in the present invention offers a more compact space requirement compared to that of the Brothers Melly escapement. The comparison of FIGS. 1 (Brothers Melly) and 2 immediately shows the advantage provided by the present invention, since the total length of the new escapement is significantly reduced.

Figure 2:
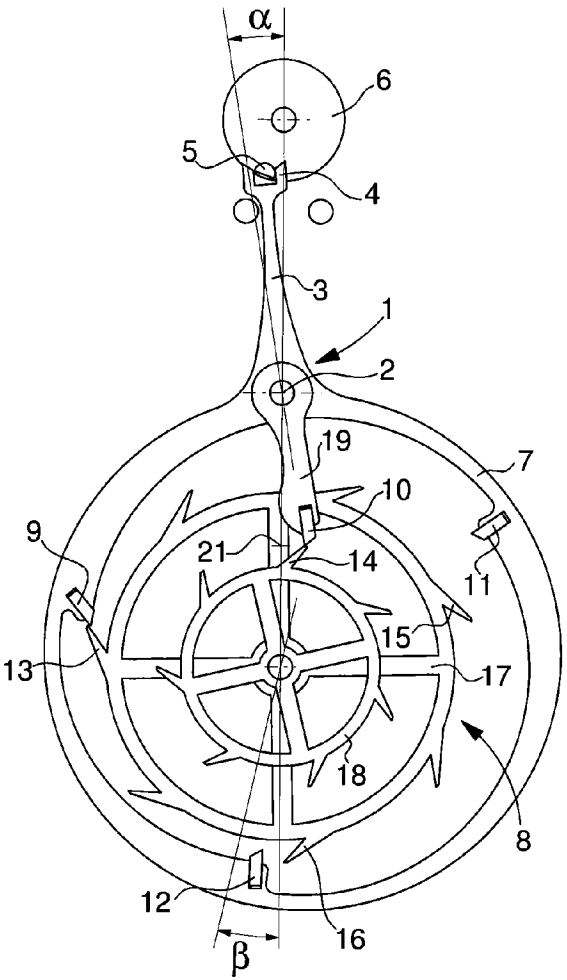
FIG. 2 is a plan view of the escapement according to the invention illustrating the end of the impulse by the small wheel.
Figure 3:
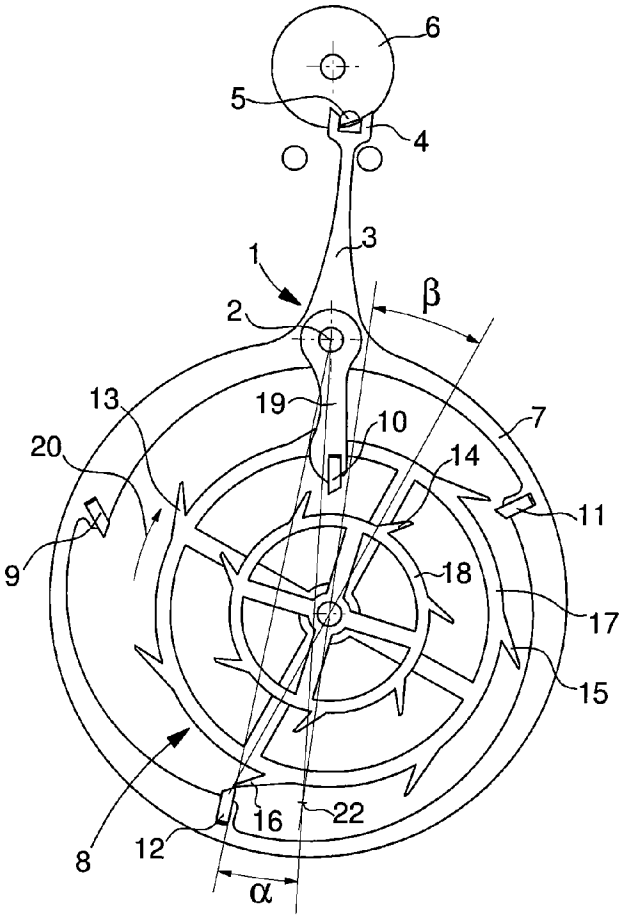
FIG. 3 is a plan view of the escapement according to the invention illustrating the end of the impulse by the large wheel.

It was also stated that the new escapement has improved security compared to that offer by the Brothers Melly. FIGS. 2 and 3 show proof of this.

Figure 6:
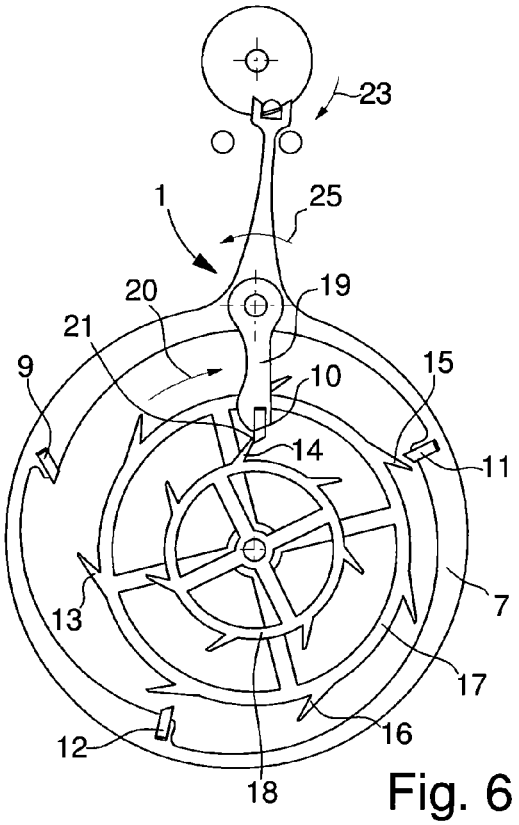
Figure 7:
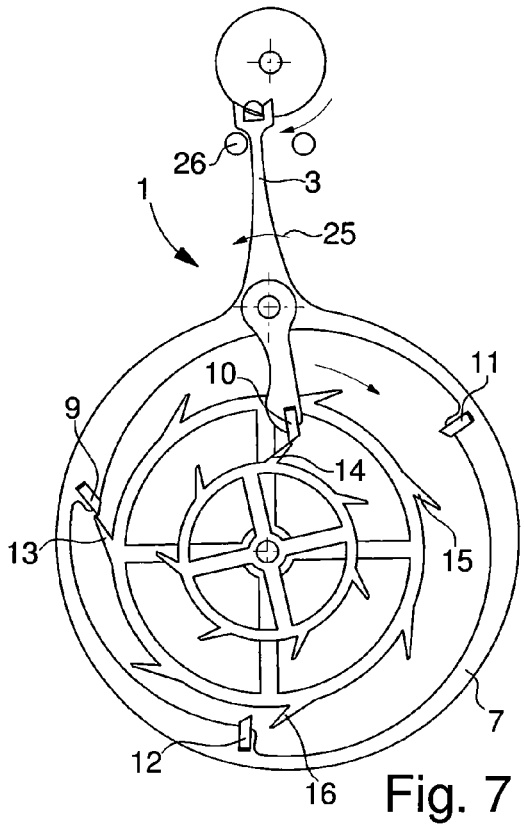

FIG. 2 is an enlargement of FIG. 7 and shows the end of the impulse caused by tooth 14 on impulse face 10, the start of the impulse being embodied by point 21 (added from FIG. 6). The angle $\alpha$ traveled by impulse pallet-stone 10, which is 9 degrees is measured, and then the angle $\beta$ traveled by tooth 14 which is 13 degrees, these values being respectively 2 and 8 degrees with the Brothers Melly escapement. Compared to the Brothers Melly escapement, the angle $\alpha$ traveled by impulse pallet-stone 10 is thus at least four times larger in the escapement of the invention, which can only improve the security of the system proposed.

Figure 12:
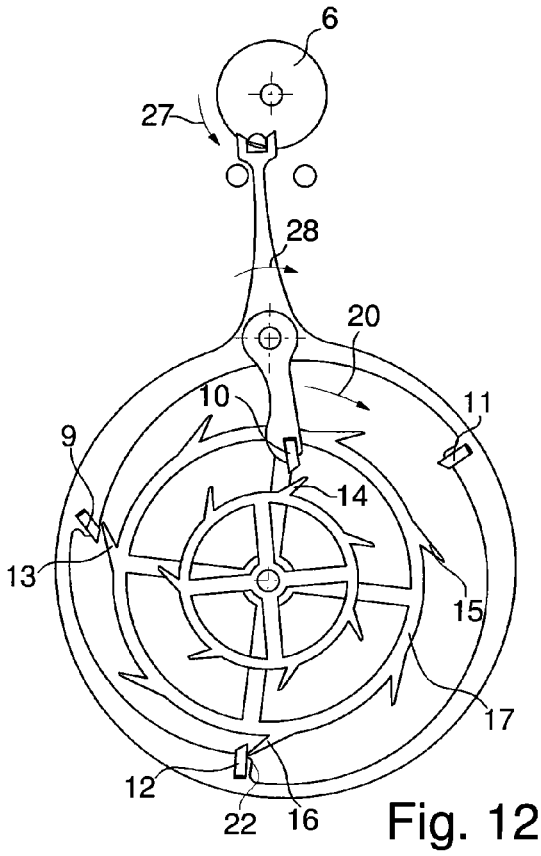
Figure 13:
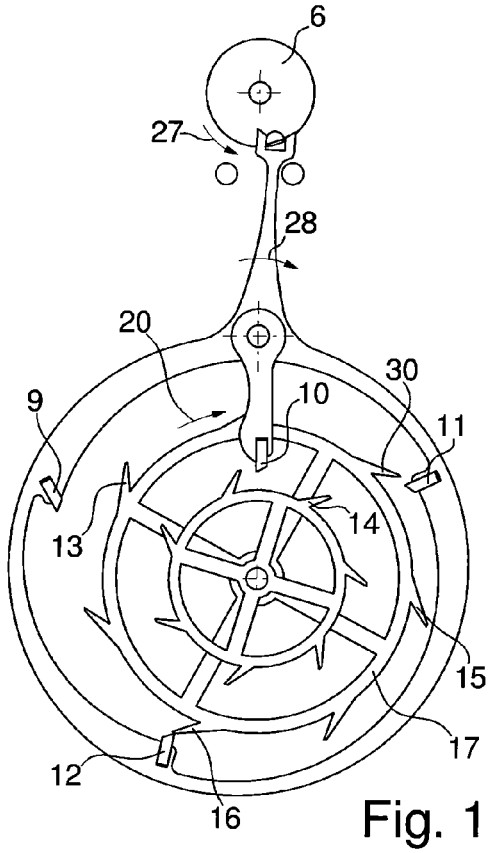
Figure 14:
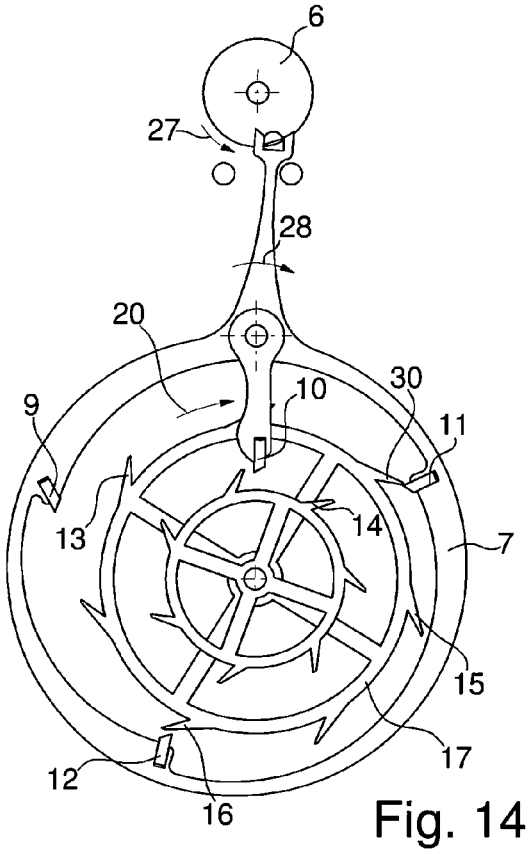

FIG. 3 is an enlargement of FIG. 13 and shows the end of the impulse caused by tooth 16 on impulse pallet-stone 12, the start of the impulse being embodied by the point 22 (added from FIG. 12). As for the preceding Figure, the angle $\alpha$ traveled by impulse pallet-stone 12, which is 8.5 degrees is measured, and then the angle $\beta$ traveled by tooth 16 which is 21 degrees, these values being respectively 3.5 and 14 degrees with the Brothers Melly escapement. It will be noted again that the angle $\alpha$ traveled by impulse pallet-stone 12 is larger in the present invention than in the prior art in a ratio of 8.5:3.5, namely of 2.5. Here again the security of the system has been improved.

One complete oscillation of roller 6, which drives the balance (not shown) is illustrated in FIGS. 4 to 15. The various operating phases will now be examined.

Figure 4:
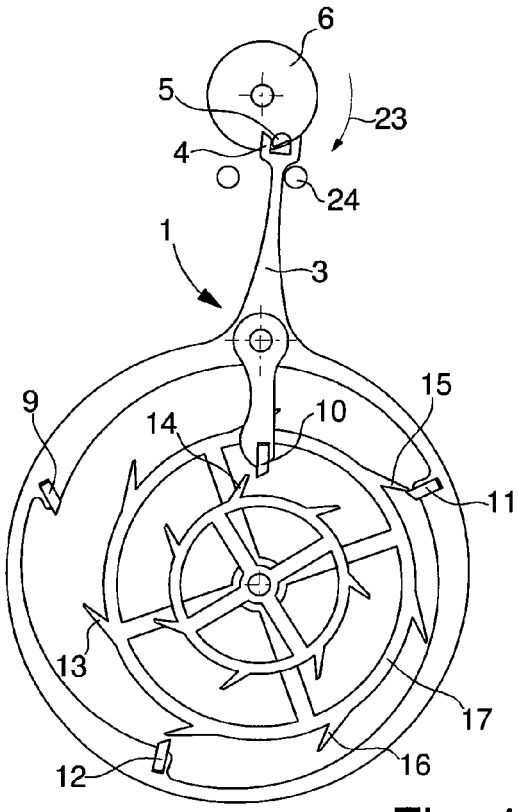
FIGS. 4 to 15 are plan views explaining the operating phases of the escapement according to the invention, these phases covering one complete oscillation of the roller.

In FIG. 4, the tooth 15 of the large escape wheel 17 is immobilised on locking pallet-stone 11 when impulse pin 5 of roller 6 rotating in the direction of arrow 23 penetrates fork 4. This is the start of the release. Lever 3 of lever device 1 rests against a stop pin 24.

Figure 5:
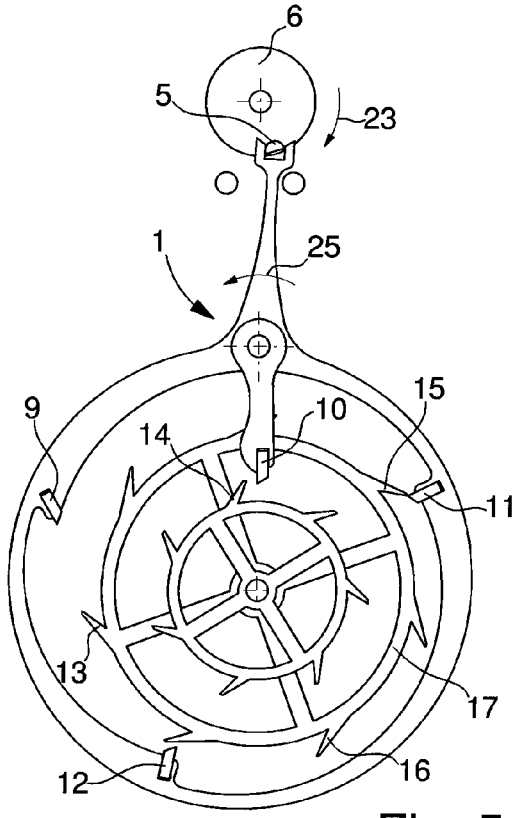

In FIG. 5, impulse pin 5, driven by roller 6 continuing to rotate in the direction of arrow 23, drives lever device 1 in the direction of arrow 25. Locking face 11 no longer holds tooth 15 and escape wheel 17 is released.

As FIG. 6 shows, the released wheel 17 can then rotate in the direction of arrow 20 driven as it is by the gear train of the timepiece. Tooth 14 of the small escape wheel 18 enters into contact with impulse pallet-stone 10 secured to the end of leg 19. This is the start of the impulse by the small wheel 18 which forces lever device 1 to continue to rotate in the direction of arrow 25.

The end of the impulse is shown in FIG. 7. Tooth 14 has left pallet-stone 10. Lever 3 of lever device 1 has rotated in the direction of arrow 25 and is ready to abut against a stop pin 26. Ring 7 having also swing in the direction of arrow 25, tooth 13 of large wheel 17 has moved nearer to locking pallet-stone 9 carried by ring 7.

Figure 8:
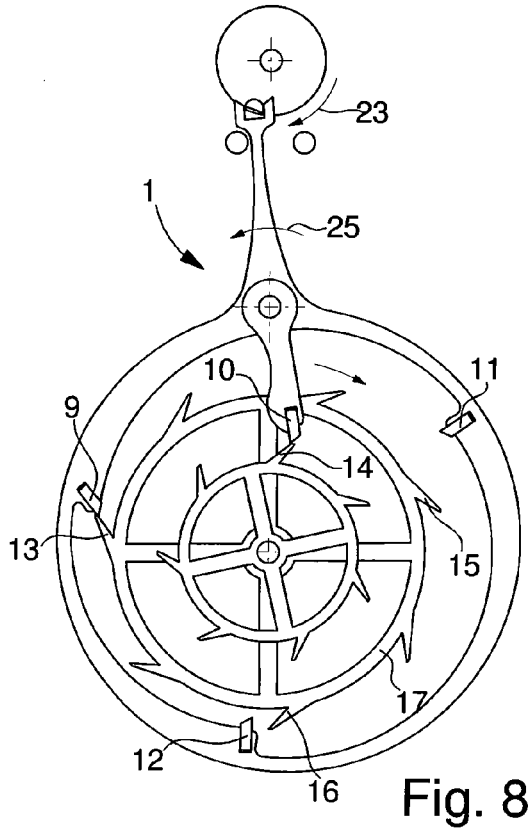

The locking position of tooth 13 on locking pallet-stone 9, which locks large wheel 17, is shown in FIG. 8.

Figure 9:
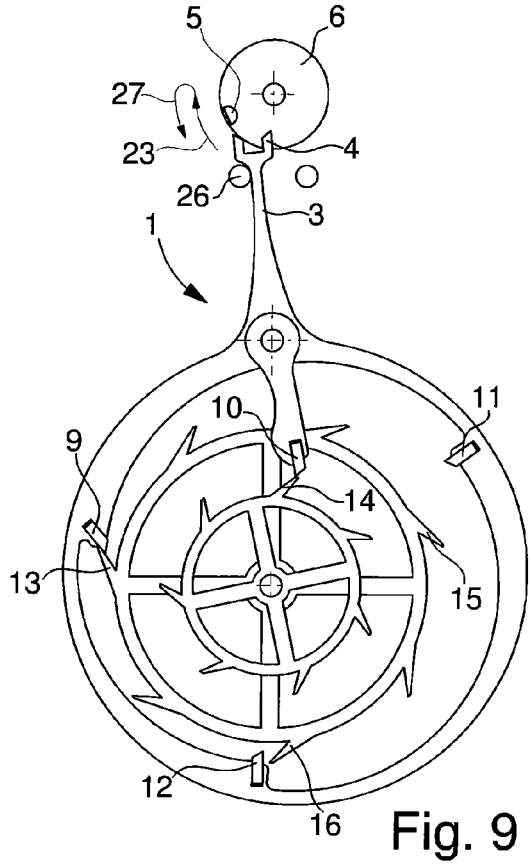

In FIG. 9, the force exerted by tooth 13 on locking pallet-stone 9, which is known to timepiece makers by the name of draw, causes the tip of tooth 13 to slide more deeply onto pallet-stone 9. This movement is stopped by the stop pin 26 at the moment that lever 3 abuts against said pin. This situation represents the total locking of lever device 1. From this moment, impulse pin 5 leaves fork 4 and roller 6, sent back by the impulse that it has received from tooth 14 (FIG. 6), accomplishes its additional arc in the direction of arrow 23, then, when it has reached the end of travel reverses its direction as indicated by arrow 27.

Figure 10:
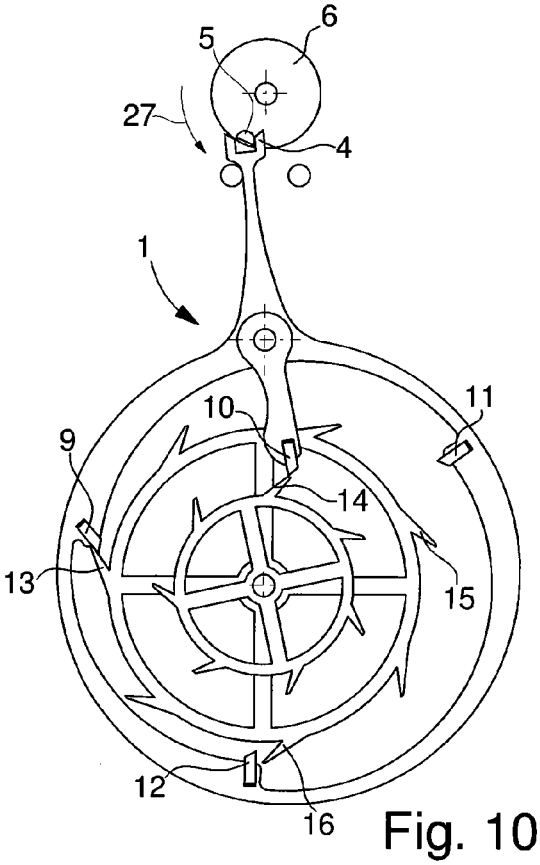

Impulse pin 5 of roller 6 then penetrates fork 4 causing the start of the release of tooth 13 from the hold of pallet-stone 9 as is shown in FIG. 10.

Figure 11:
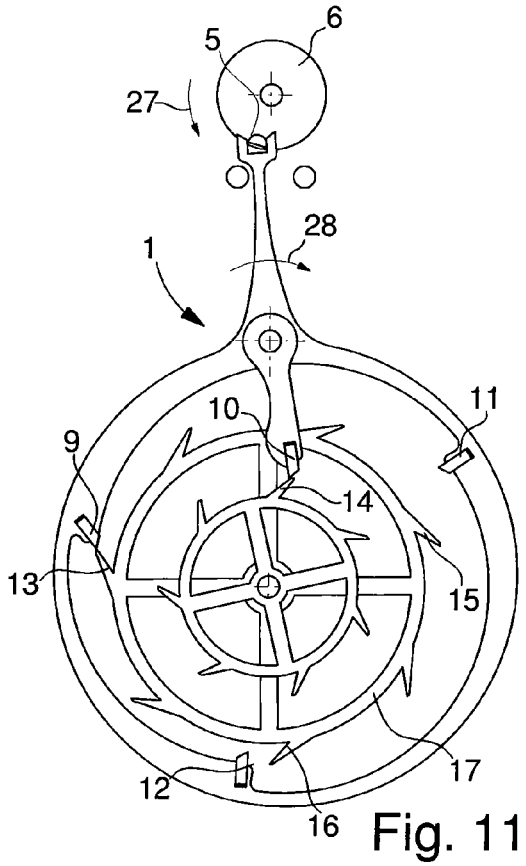

In FIG. 11, impulse pin 5 drives lever device 1 in the direction of arrow 28, roller 6 continuing its travel along the direction of arrow 27. The release of tooth 13 is then total, which will release wheel 17.

As can be seen in FIG. 12, wheel 17 driven by the gear train rotates in the direction of arrow 20. Tooth 16 of wheel 17 then enters into contact with impulse pallet-stone 12 and this is the start of a new impulse, which causes the lever device to rotate in the direction of arrow 28 and sends roller 6 back in the direction of arrow 27.

The end of the impulse on the large wheel 17 is shown in FIG. 13. Lever 3 has moved closer to stop pin 24. Wheel 17 is then free to continue its travel along arrow 20.

The continued travel of wheel 17 along the direction of arrow 20 causes tooth 30 to encounter locking pallet-stone 11 arranged on ring 7. This is a locking phase that locks wheel 17, illustrated by FIG. 14.

Figure 15:
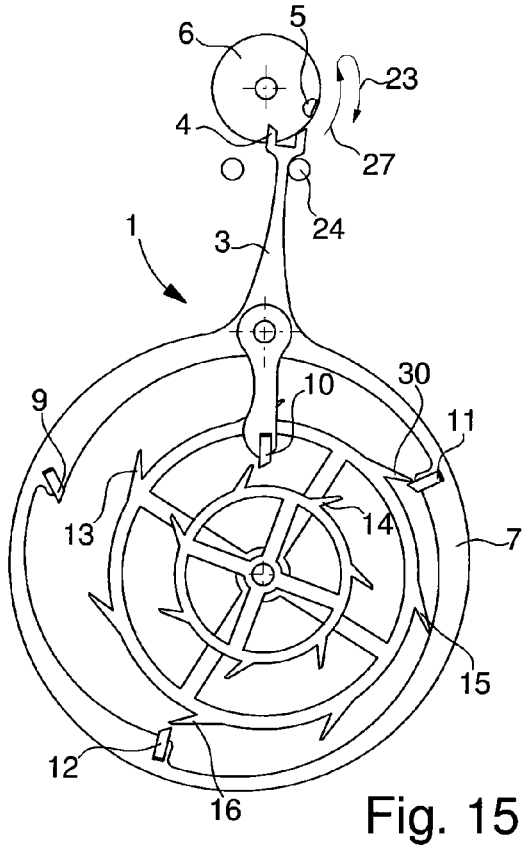

FIG. 15 shows the total locking of tooth 30 on pallet-stone 11. The draw exerted by the rotational force of wheel 17 has caused tooth 30 to penetrate more deeply along locking face 11 until this movement is stopped by fork 4 meeting stop pin 24. From now on, roller 6, sent back by the impulse it has received from tooth 16 (FIG. 12), can travel freely along its additional arc in the direction of arrow 27, since impulse pin 5 has left fork 4, when the roller reaches the end of its travel, its direction is reversed as indicated by arrow 23.

One cycle or oscillation of lever device 1 has thus finished and will immediately start again. Indeed, impulse pin 5 returning along the direction of arrow 23, will penetrate fork 4, which returns the reader to the situation presented in FIG. 4.

What is claimed is:

1. A tangential impulse escapement including a lever device hinged on a pivot, said lever device including as a first arm a lever ending in a fork for cooperating with an impulse pin of a roller and as a second arm, opposite to the first, a ring substantially surrounding an escapement wheel set, said ring being fitted with pallet locking pallet-stones and impulse pallet-stones for cooperating with the teeth of said wheel set, in order, alternately, to lock the latter and then impart to said roller an impulse, wherein the escapement wheel set includes a plurality of secured and coaxial wheels, including at least first and second wheels, the first wheel having a larger diameter than the second, the first and second wheels each cooperating with an impulse pallet-stone fitted to the ring, the locking pallet-stones being arranged for cooperating with any of the wheels of the escapement wheel set.

2. The escapement according to claim 1, wherein the ring includes first and second impulse pallet-stones respectively cooperating with the teeth of the first and second escapement wheels, and first and second pallet locking faces cooperating with the teeth of the first escapement wheel.

3. The escapement according to claim 2, wherein the pallet-stones are arranged alternately inside the ring, the first impulse face being followed by the first locking pallet-stone, the latter being followed in turn by the second impulse pallet-stone, the latter being followed finally by the second locking pallet-stone.

4. The escapement according to claim 2, wherein the second impulse pallet-stone is secured to the end of a leg, said leg being secured to the ring by the other end thereof.

5. The escapement according to claim 4, wherein the leg is orientated substantially in the extension of the lever forming part of the first arm of the lever device.

* * * * *